US006722966B1

(12) United States Patent
Wang

(10) Patent No.: US 6,722,966 B1
(45) Date of Patent: Apr. 20, 2004

(54) SAND-BELT FINISHING MACHINE HAVING A RECIPROCAL MOVEMENT MECHANISM

(76) Inventor: Wang Tien Wang, No. 45, Yi Chang East Rd., Taiping, Taichung Hsien (TW), 411

( * ) Notice: Subject to any disclaimer, the term of this patent is extended or adjusted under 35 U.S.C. 154(b) by 0 days.

(21) Appl. No.: 10/285,534

(22) Filed: Nov. 1, 2002

(51) Int. Cl.[7] ..... B24B 21/00
(52) U.S. Cl. ..... 451/304; 451/310; 451/168
(58) Field of Search ..... 451/167, 296, 451/168, 304, 310, 297, 299, 300

(56) References Cited

U.S. PATENT DOCUMENTS 4,864,775 A * 9/1989 David
6,089,958 A * 7/2000 Costa et al. ..... 451/59
6,471,568 B1 * 10/2002 Wang ..... 451/168

* cited by examiner

*Primary Examiner*—Eileen P. Morgan
(74) *Attorney, Agent, or Firm*—Rosenberg, Klein & Lee

(57) ABSTRACT

A sand-belt finishing machine having a reciprocal movement mechanism includes a main body, a swingable support rack, a finishing device, and an eccentric device. Thus, the eccentric unit of the eccentric device produces a driving force to pull and push the first roller of the finishing device, so that the first roller is oscillated successively and produces a vibration or shock force on the sand belt of the finishing device, so as to remove and clear the powder chips attached on the surface of the sand belt.

4 Claims, 4 Drawing Sheets

SAND-BELT FINISHING MACHINE HAVING A RECIPROCAL MOVEMENT MECHANISM

BACKGROUND OF THE INVENTION

1. Field of the Invention

The present invention relates to a sand-belt finishing machine having a reciprocal movement mechanism, and more particularly to a sand-belt finishing machine having a reciprocal movement mechanism that produces a driving force to pull and push the first roller, so that the first roller is oscillated successively and produces a vibration or shock force on the sand belt, so as to remove and clear the powder chips attached on the surface of the sand belt.

2. Description of the Related Art

The sand-belt finishing machine is a working machine that is used to finish the surface of the wooden material. A conventional sand-belt finishing machine in accordance with the prior art comprises a transverse roller, and a sand belt wound around the surface of the roller. When in use, the wooden material is passed through the lower side of the roller which is being rotated, so that the wooden material is rubbed and finished by the sand belt on the surface of the roller, thereby achieving a finishing effect. The powder chips attached on the surface of the sand belt need to be removed and cleared during a long-term utilization. In general, the sand belt is fixed on the sand-belt finishing machine, so that the user needs to use a tool, such as a brush, to clear the powder chips attached on the surface of the sand belt when the sand belt is being rotated, thereby causing inconvenience to the user, and thereby wasting the manual work. In addition, if the wooden material is passed through the lower side of the roller in an oblique or skew manner, a partial area of the surface of the wooden material is not finished by the sand belt, thereby decreasing the finishing effect.

SUMMARY OF THE INVENTION

The present invention has arisen to mitigate and/or obviate the disadvantage of the conventional sand-belt finishing machine.

The primary objective of the present invention is to provide a sand-belt finishing machine having a reciprocal movement mechanism, wherein the eccentric unit produces a driving force to pull and push the first roller, so that the first roller is oscillated successively and produces a vibration or shock force on the sand belt, so as to remove and clear the powder chips attached on the surface of the sand belt.

Another objective of the present invention is to provide a sand-belt finishing machine having a reciprocal movement mechanism, wherein the first roller is oscillated successively, so that the sand belt produces a transverse displacement so as to increase the contact area between the sand belt and the surface of the wooden material, thereby enhancing the finishing effect.

In accordance with the present invention, there is provided a sand-belt finishing machine having a reciprocal movement mechanism, comprising:

a main body;

a swingable support rack mounted on the main body;

a finishing device mounted on the main body; and an eccentric device mounted on the main body; wherein:

the finishing device includes a first roller mounted on the swingable support rack, a second roller, and a sand belt mounted around the first roller and the second roller;

the eccentric device includes an eccentric unit, and a pull lever, wherein the eccentric unit of the eccentric device is secured on the support rack, and the pull lever of the eccentric device has a first end connected to the eccentric unit of the eccentric device, and a second end secured on the main body; and the finishing device is operated to drive the eccentric device to move synchronously, so that the first roller is oscillated by movement of the eccentric device.

Further benefits and advantages of the present invention will become apparent after a careful reading of the detailed description with appropriate reference to the accompanying drawings.

DETAILED DESCRIPTION OF THE INVENTION

Figure 1:
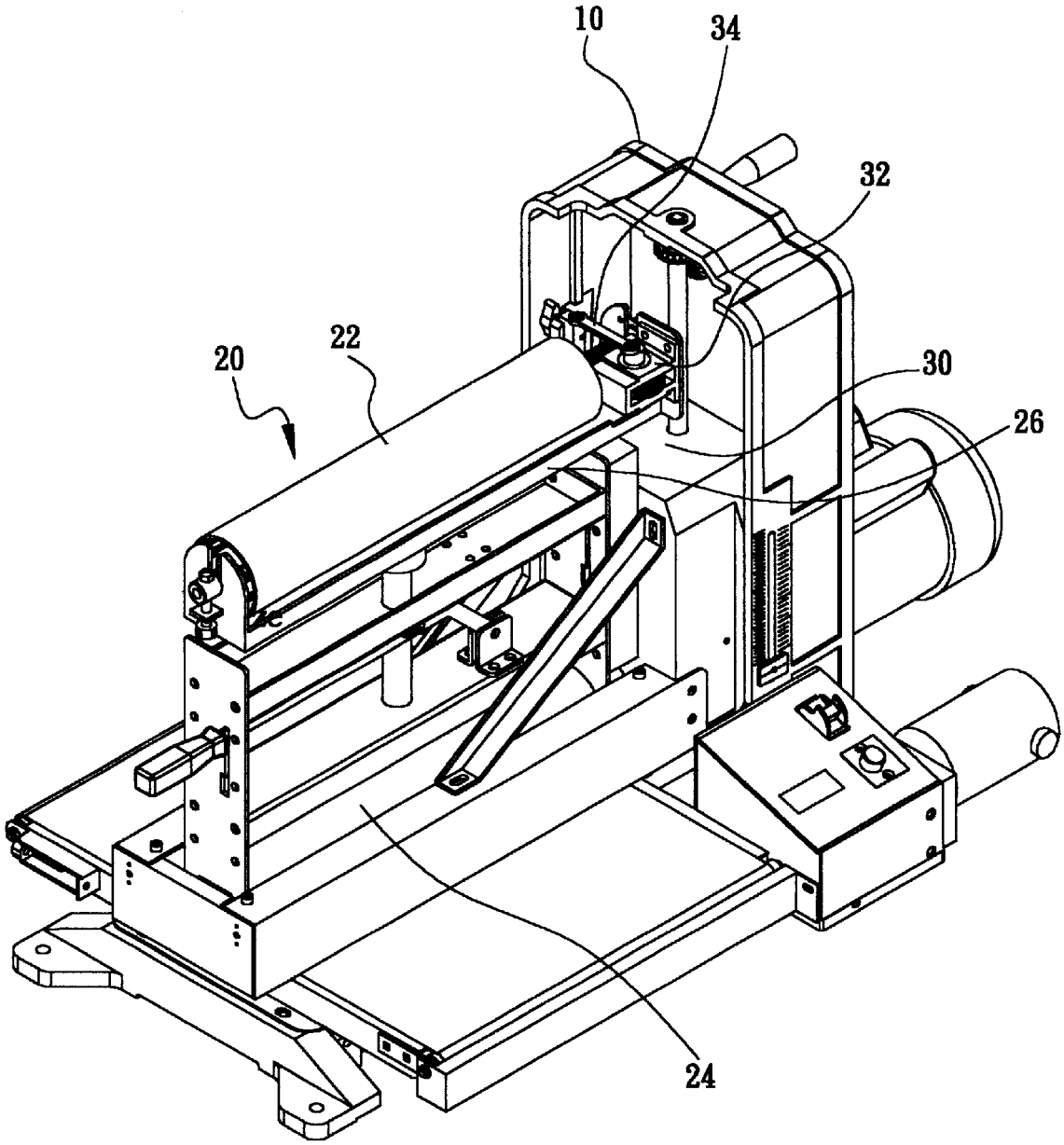
FIG. 1 is a perspective view of a sand-belt finishing machine having a reciprocal movement mechanism in accordance with a preferred embodiment of the present invention.

Referring to the drawings and initially to FIG. 1, a sand-belt finishing machine having a reciprocal movement mechanism in accordance with a preferred embodiment of the present invention comprises a main body 10, a finishing device 20 mounted on the main body 10, and an eccentric device 30 mounted on the main body 10. The finishing device 20 includes a first roller 22, a second roller 24, and a sand belt 40 (see FIG. 4) mounted around the first roller 22 and the second roller 24. The first roller 22 and the second roller 24 are in parallel with each other. The first roller 22 is mounted on a swingable support rack 26 that is mounted on the main body 10. The sand belt 40 having a loop shape is mounted-on the first roller 22 and the second roller 24.

Figure 2:
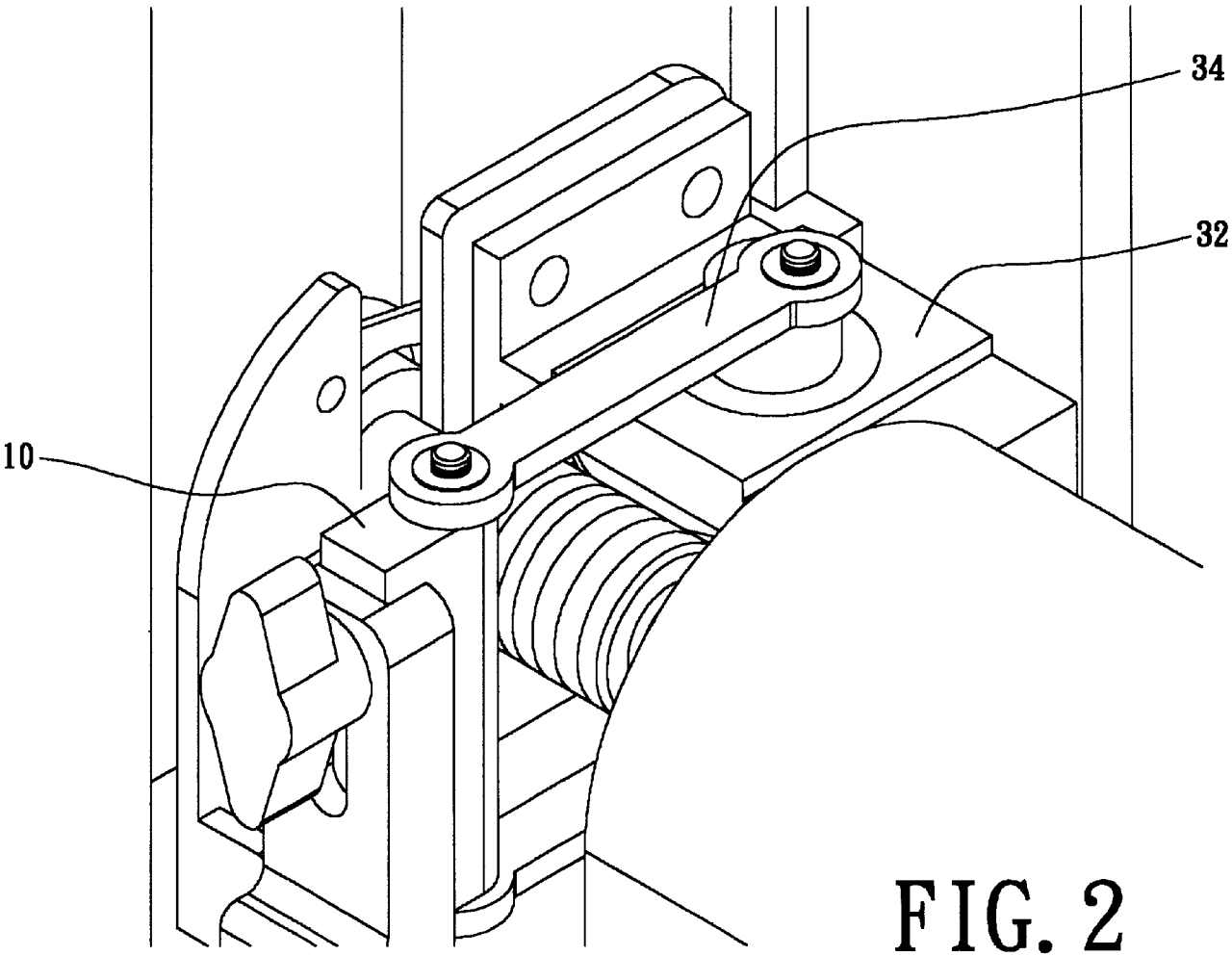
FIG. 2 is a partially enlarged view of the sand-belt finishing machine having a reciprocal movement mechanism as shown in FIG. 1.

Referring to FIGS. 1 and 2, the eccentric device 30 includes an eccentric unit 32, and a pull lever 34. The eccentric unit 32 of the eccentric device 30 is secured on the support rack 26. The pull lever 34 of the eccentric device 30 has a first end connected to the eccentric unit 32 of the eccentric device.30, and a second end secured on the main body 10.

Figure 3:
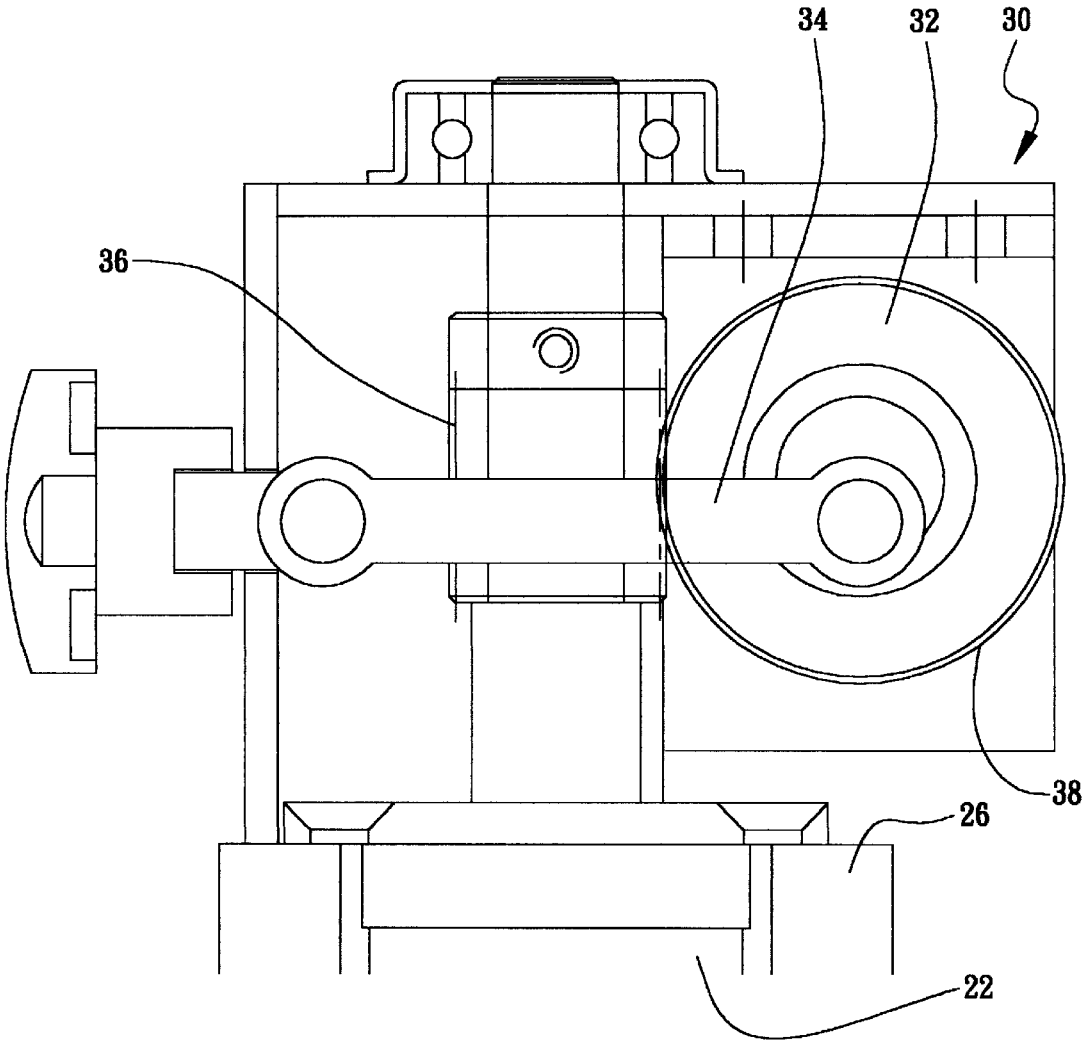
FIG. 3 is a partially top plan enlarged view of the sand-belt finishing machine having a reciprocal movement mechanism as shown in FIG. 1.

Referring to FIG. 3, the eccentric unit 32 of the eccentric device 30 includes a worm 36, and a worm wheel 38 co-operating with the worm 36 so as to drive the eccentric unit 32 of the eccentric device 30. The first end of the pull lever 34 of the eccentric device 30 is eccentrically mounted on the worm wheel 38 of the eccentric unit 32 of the eccentric device 30. It is appreciated that, the power source for rotating the first roller 22 may be used to drive and rotate the eccentric unit 32 of the eccentric device 30. Thus, the worm 36 of the eccentric unit 32 of the eccentric device 30 is rotated by the power source of rotating the first roller 22, to rotate the worm wheel 38 of the eccentric unit 32 of the eccentric device 30, so as to move the pull lever 34 of the eccentric device 30.

Figure 4:
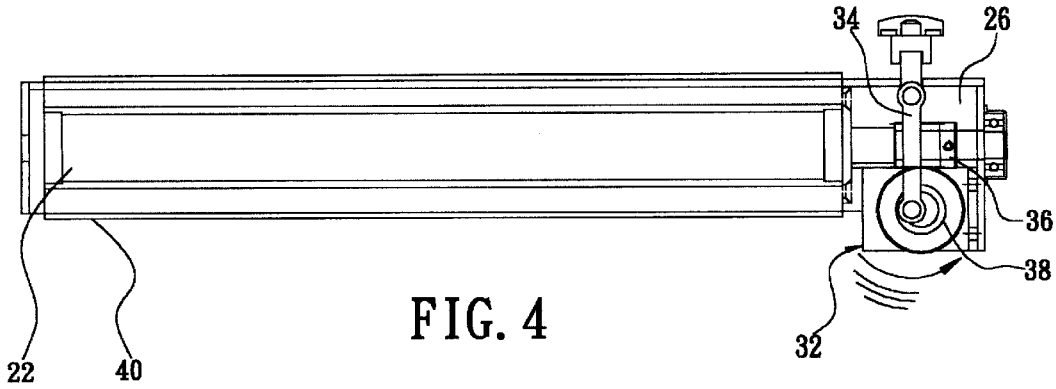
FIG. 4 is schematic top plan view of the sand-belt finishing machine having a reciprocal movement mechanism as shown in FIG. 1.

Referring to FIG. 4, when the relative position between the pull lever 34 of the eccentric device 30 and the worm wheel 38 of the eccentric unit 32 of the eccentric device 30 is as shown in FIG. 4, the first roller 22 is located at a horizontal state, and the sand belt 40 is located at the mediate position of the first roller 22.

Figure 5:
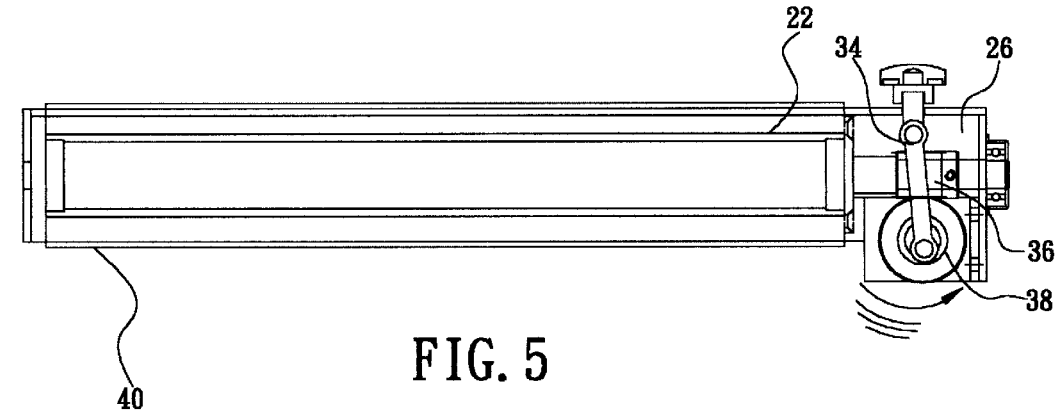
FIG. 5 is a schematic operational view of the sand-belt finishing machine having a reciprocal movement Mechanism as shown in FIG. 4 in use.

Referring to FIG. 5, when the worm wheel 38 is rotated and moved to the position as shown in FIG. 5, the first end of the pull lever 34 is eccentrically mounted on the worm wheel 38 of the eccentric unit 32 and the second end of the pull lever 34 is secured on the main body 10, so that the eccentric unit 32 is pulled by the pull lever 34 to move toward the main body 10, thereby driving the support rack 26 to swing and oscillate (because the eccentric unit 32 is secured on the support rack 26). Thus, the first roller 22 mounted on the swingable support rack 26 is oscillated with the support rack 26.

Figure 6:
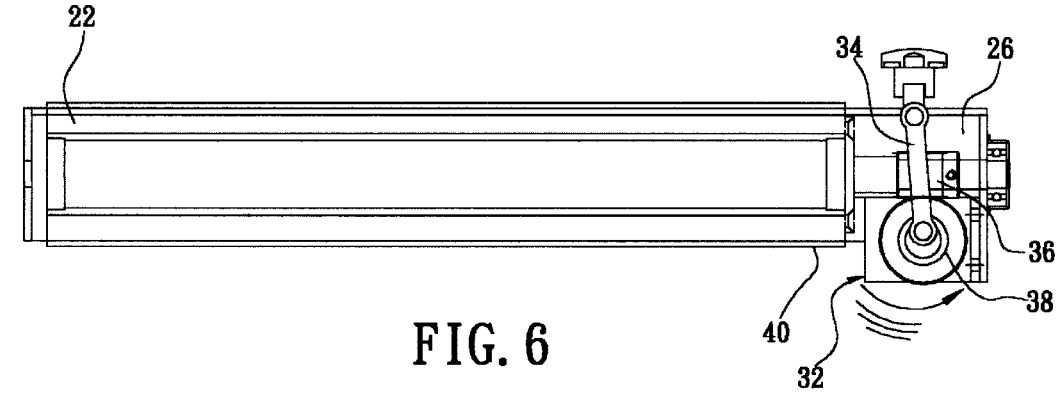
FIG. 6 is a schematic operational view of the sand-belt finishing machine having a reciprocal movement mechanism as shown in FIG. 5 in use.

Referring to FIG. 6, when the worm wheel 38 is rotated and moved to the position as shown in FIG. 6, the eccentric unit 32 is pushed by the pull lever 34 to move along the direction away from the main body 10, thereby driving the support rack 26 to swing and oscillate. Thus, the first roller 22 mounted on the swingable support rack 26 is oscillated with the support rack 26.

In conclusion, when the finishing device 20 is operated, the eccentric device 30 is also operated synchronously, so as to drive the first roller 22 to oscillate and vibrate successively. Thus, the first roller 22 that is oscillated successively will produce a vibration or shock force on the sand belt 40, so as to remove and clear the powder chips attached on the surface of the sand belt 40, without having to stop operation of the sand-belt finishing machine for removing the powder chips, and without having to remove and clear the powder chips by a tool, such as a brush, thereby facilitating the user removing and clearing the powder chips, and thereby saving the manual work.

In addition, as shown in FIGS. 4–6, when the first roller 22 is oscillated successively, the first roller 22 applies a partial force to move the sand belt 40 in a transverse manner. Thus, the transverse displacement of the sand belt 40 increase the contact area between the sand belt 40 and the surface of the wooden material, thereby enhancing the finishing effect.

Accordingly, in the sand-belt finishing machine having a reciprocal movement mechanism in accordance with the preferred embodiment of the present invention, the eccentric unit 32 may produce a driving force to pull and push the first roller 22, so that the first roller 22 is oscillated successively and produces a vibration or shock force on the sand belt 40, so as to remove and clear the powder chips attached on the surface of the sand belt 40. In addition, the first roller 22 is oscillated successively, so that the sand belt 40 produces a transverse displacement so as to increase the contact area between the sand belt 40 and the surface of the wooden material, thereby enhancing the finishing effect.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A sand-belt finishing machine having a reciprocal movement mechanism, comprising:

a main body;

a swingable support rack mounted on the main body;

a finishing device mounted on the main body; and an eccentric device mounted on the main body; wherein:

the finishing device includes a first roller mounted on the swingable support rack, a second roller, and a sand belt mounted around the first roller and the second roller;

the eccentric device includes an eccentric unit, and a pull lever, wherein the eccentric unit of the eccentric device is secured on the support rack, and the pull lever of the eccentric device has a first end connected to the eccentric unit of the eccentric device, and a second end secured on the main body; and the finishing device is operated to drive the eccentric unit of the eccentric device to move synchronously, so as to move the support rack which moves the first roller so that the first roller is oscillated by movement of the eccentric device.

2. The sand-belt finishing machine having a reciprocal movement mechanism in accordance with claim 1, wherein the first roller of the finishing device and the eccentric unit of the eccentric device are operated by the same power source so that when the first roller of the finishing device is rotated, the eccentric unit of the eccentric device is moved synchronously.

3. The sand-belt finishing machine having a reciprocal movement mechanism in accordance with claim 1, wherein the eccentric unit of the eccentric device includes a worm, and a worm wheel co-operating with the worm.

4. The sand-belt finishing machine having a reciprocal movement mechanism in accordance with claim 3, wherein the first end of the pull lever of the eccentric device is eccentrically mounted on the worm wheel of the eccentric unit of the eccentric device.

* * * * *